US005282693A

United States Patent [19]

Daily, Jr.

[11] Patent Number: 5,282,693

[45] Date of Patent: Feb. 1, 1994

[54] ELASTOMERIC SEALING APPARATUS FOR HIGHWAY JOINTS

[76] Inventor: Ralph D. Daily, Jr., 63 Maple Ave., Unionville, Conn. 06085

[21] Appl. No.: 808,631

[22] Filed: Dec. 16, 1991

[51] Int. Cl.[5] ..... E01C 11/02; E01C 11/04; E04F 15/14

[52] U.S. Cl. ..... 404/47; 404/68; 52/396

[58] Field of Search ..... 404/47, 70, 48, 74, 404/49, 56, 65-69; 49/475; 52/393, 698; 14/73.1

[56] References Cited

U.S. PATENT DOCUMENTS

| | | | |
|---|---|---|---|
| 3,829,228 | 8/1974 | Miyazaki et al. | 404/68 |
| 4,111,584 | 9/1978 | Fyfe | 404/69 |
| 4,245,925 | 1/1981 | Pyle | 404/69 X |
| 4,285,612 | 8/1981 | Betti | 52/396 X |
| 4,290,249 | 9/1981 | Mass | 52/396 |
| 4,295,311 | 10/1981 | Dahlberg | 52/396 |
| 4,456,398 | 6/1984 | Ceintrey | 404/69 |
| 4,634,133 | 1/1987 | Wercholoz | 404/69 X |
| 5,048,249 | 9/1991 | Shreiner | 404/69 X |
| 5,125,763 | 6/1992 | Seantier | 14/73.1 X |

*Primary Examiner*—James R. Brittain
*Assistant Examiner*—Nancy P. Connolly

[57] ABSTRACT

An elastomeric sealing apparatus for waterproofing a joint opening between two generally parallel structural members in highways, bridges, parking structures and the like. The sealing apparatus comprises an elongated web shaped elastomeric body member which assumes a bowed contour after installation and which spans a joint opening defined by the faces of two confronting structural members such as roadway slabs or the like. The body member has side flaps extending integrally along each longitudinal edge thereof. The side flaps are adapted by steps and outward bias for adhesive bonding to the joint faces so as to provide watertightness, easy installation, and long term resistance to climatic conditions and structural movements.

8 Claims, 5 Drawing Sheets

ELASTOMERIC SEALING APPARATUS FOR HIGHWAY JOINTS

BACKGROUND OF THE INVENTION

This invention relates to the construction of bridges, roadways, parking garages, pedestrian walkways, and similar structures and more particularly to expansion joints disposed between the slabs or other elements that form these structures. The need for such expansion joints between adjacent structural members to permit movements caused by changes in the ambient temperature has long been recognized within the art. In reality, there are actually many kinds of relative movement between adjacent structural members and all of these movements must be considered in the design of a successful expansion joint. For example, up and down movements caused by traffic loadings can occur. Relative rotation of the structural members can also occur. Growth of the joint opening, caused by shrinkage of concrete pavement sections, may also occur in addition to the continual effects of thermal expansion and contraction.

The prior art includes various structures which are generally relevant. U.S. Pat. No. 4,290,249 to Mass describes an elastomeric spring expansion joint-seal strip that is generally M-shaped. The structure described therein appears to rely exclusively on its compressive characteristics to achieve its sealing abilities. Many factors, such as irregularities in the joint sides, and especially excessive width of the joint opening, make this and other compressive seal designs unlikely to be fully watertight. This design also requires spring means embedded within the seal strip. These spring means increase the fabrication costs of this seal strip. U.S. Pat. No. 4,295,311 to Dahlberg describes an expansion joint element for forming a surface joint between two concrete construction parts. The structure described therein is difficult to install in many cases because the traffic cannot run over this structure until sufficient time has elapsed for its adhesive bonding material to cure. This cure period is often too long to accommodate modern traffic conditions. Moreover, this expansion joint is often installed in individual sections which must be joined together at the time of installation. These "stage joints" are notoriously prone to failure and leakage.

U.S. Pat. No. 4,111,584 to Fyfe describes an inverted U-shaped member that is clamped to the opposed walls and which is further restrained by complex abutments. The nature of the abutment ensures that the structure would be difficult and time consuming to install as well as expensive to manufacture. Other prior art patents actually require the installation of a portion of the seal to be embedded in the slabs of the bridge or other structure. See for example U.S. Pat. No. 3,172,237 to Bradley and the known Wabocrete/Membrane 101 System.

Although these types of seals bear some resemblance to the present invention because they have side flaps, there is in fact a very important difference between them and the present invention. Namely, the side flaps of such seals are "buried" underneath the joint header material which makes their removal and replacement for maintenance purposes very expensive. This is because all of the header material must be removed and then replaced in order to install a new one of these seals. In the present invention the seal apparatus may be removed and replaced without concurrent removal of the joint headers. Another, general problem with designs of this type is that water collects in the "V's" between the headers and the sealing element and this water can migrate under the headers and expand when it freezes. This can lead to break up of the joint headers. In the present invention, the water collects only in the elastomeric portions of the sealing element where freezing water can do no damage.

Other U.S. Pat. Nos. of background interest include 3,381,436; 3,829,228; 3,838,931; 3,850,539; 4,285,612; and 4,634,133.

It is imperative that the expansion joint prevent the harmful passage of water through the joint opening. This is particularly harmful in bridges because the water can cause very severe damage to the bridge bearing devices that accommodate expansion and contraction of the bridge sections. Damage to the steel superstructure can also be caused by the water which also results in frequent maintenance procedures.

Many known seals for such joints incorporate metal plates, angles, extruded "jaws" and the like. Such materials are referred to herein as "metal work". Along with other drawbacks, metal work is difficult to repair should it become damaged.

Another problem with the prior art apparatus is that it often will not function when the interface between concrete sections has steps or bends. Stated another way, the prior art seals often do not satisfactorily cooperate with sharp upturns, downturns, or sideways bends in the joint opening. Such angular bends of the joint opening are often encountered at curbs, on bridges and other structures.

Still other problems with the known seals is that they do not consistently prevent the accumulation of excessive foreign matter, such as sand and gravel, in the joint. Another problem with many known seals is that the seal has a relatively large height and this limits the places where the seal can be installed and particularly may prevent installation on many bridges that are being repaired. Many known seals will not function when there is a variation in the width of the joint opening along the longitudinal extent thereof. Because there are inherently substantial tolerances in the placement of the huge slabs and the like involved in such structures it is undesirable to have a seal that will not function in such an environment.

It is an object of the invention to provide a seal apparatus that is capable of accommodating a wide variety of different movements.

It is another object of the invention to provide a seal that will prevent the passage of water into the space between concrete or other slab shaped sections of material.

It is another object of the invention to provide a seal that can be replaced without concurrent removal of the joint headers.

Still another object of the invention is to provide a seal that has a relatively low height and thus will be dimensionally suitable for installation in a wide range of applications.

Yet another object of the invention is to provide a structure that can easily accommodate itself to different roadway cross slopes, as well as to width variation (or "waviness") of the joint opening.

SUMMARY OF THE INVENTION

It has now been found that these and other objects of the invention may be attained in a seal apparatus or seal for adhesive installation in a structural joint opening having spaced generally planar, generally parallel spaced faces which comprises an elongated web shaped elastomeric body member having first and second opposed elongated borders. The first elongated border is contiguous with an elongated first external edge, and the second elongated border is contiguous with an elongated second external edge. The apparatus also comprises first and second web shaped elastomeric side flaps, and each of the side flaps is elongated and has a first elongated border. Each of these first borders is contagious with a first elongated inner edge. The first inner edge of the first side flap is fixed unitarily to the first external edge of the body member, and the first inner edge of the second side flap is fixed unitarily to the second external edge of the body member throughout the entire longitudinal extent thereof.

Each of the side flaps includes an outer surface which is disposed in generally face to face abutting relationship to the joint face after installation of the apparatus in the joint opening. Each of the side flaps further includes an inner surface which is opposite to the outer surface.

The body member includes an external surface, which is contiguous with the external edges of the body member, and the body member also includes an internal surface which is opposite to the external surface.

The side flaps are disposed in an angular relationship to the body member, and the angle will generally range from about 0 degrees to about 50 degrees.

Each of the side flaps also includes an elongated second border, which is remote from the first border of the side flap.

The body member is further dimensioned and configured so that the first and second opposed borders of the body member are disposed more remote from each other prior to insertion of the apparatus in the joint opening than are the opposed borders after insertion of the apparatus in the joint opening. The body member thereby exhibits springlike behaviour upon insertion of the apparatus in the joint opening which results in the body member urging the side flaps outwardly against the joint faces.

Each of the side flaps and the body member are further dimensioned and configured so that the second border of the side flap is disposed generally tangential to the joint face after insertion of the apparatus in the joint opening.

The apparatus also includes a first step along each of the side flaps which extends longitudinally with respect to the side flap. The first step is proximate to the first border of the side flap. The first step is dimensioned and configured so that the apparatus proximate to the first border of the side flap has a greater thickness than at other parts thereof.

In some forms of the invention the outer surface of the side flaps includes a second step. The second step may extend longitudinally with respect to the side flap. The second step may be dimensioned and configured so it projects outwardly about 1/16" relative to the adhesively bonded surface of the side flap. The second step may be located about ¾" below the second border.

In other forms of the invention the second step extends from a line located about ¾" below the second border, to the first border.

In some forms of the invention the second border of each of the side flaps is tangential to a plane projected from the outer surface of the second step prior to insertion of the apparatus in the joint opening.

In other forms of the invention the second borders may be contiguous with a beveled edge which is also contiguous with the inner surface of the side flap. The beveled edge preferably has a slope of about two vertical to one horizontal. The beveled edge may extend longitudinally with respect to the side flap.

In some forms of the invention the inner surface of each of the side flaps includes a third step. The third step may extend longitudinally with respect to the side flap. The third step may be dimensioned and configured so that the first border of the side flap has a greater width than if the third step was not a part of the apparatus.

The body member may in some cases have a width of about 2.2 times the height of a side flap. The body member may also have a fabricated rise of about 1/7th of the width of the body member prior to installation of the apparatus in a joint.

BRIEF DESCRIPTION OF THE DRAWING

The invention will be better understood by reference to the accompanying drawing in which.

DESCRIPTION OF THE PREFERRED EMBODIMENT

While the invention will be described in terms of a preferred embodiment of a bridge joint it will be understood that the invention is not limited in its application to the details of construction and arrangement of parts illustrated in the accompanying drawings, since the invention is capable of other embodiments and of being practiced or carried out in various ways. Also, it is to be understood that the phraseology or terminology employed herein is for the purpose of description and not of limitation.

In the following description, the terms "inner" and "outer" refer respectively to directions toward the center of the joint opening, and away from the center of the joint opening. The terms "internal" and "external" have a similar connotation.

Figure 1:
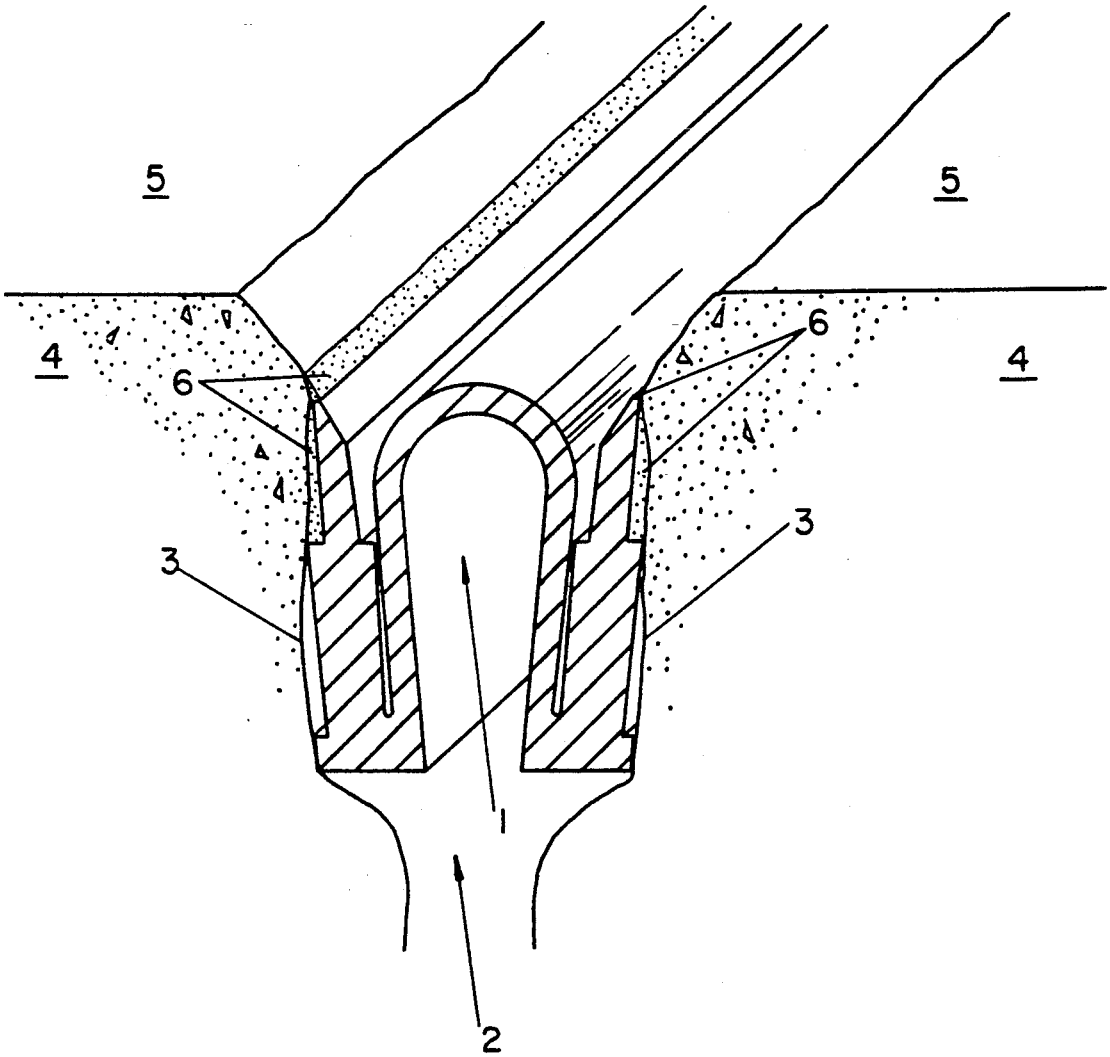
FIG. 1 is a perspective view in partial section of a joint incorporating the seal or seal apparatus in accordance with one form of the invention.

Referring now to FIGS. 1-8 there is shown a seal or seal apparatus 1. In FIG. 1 the seal apparatus 1 is shown installed within a structural joint opening 2. The joint opening 2 is defined by two spaced generally planar, generally parallel spaced faces 3,3 of two structural members 4, 4. It should be noted at this point that this arrangement of generally planar, generally parallel joint faces 3, 3 is an exceedingly common joint opening condition and this is why the present invention has been designed to function in such joint openings. The surfaces 5, 5 of the structural members 4, 4 are also indicated. These surfaces 5, 5 are located where vehicular traffic would typically be encountered, or in any case where the structural members 4, 4 are exposed to the elements. The seal apparatus 1 is dimensioned and configured to span or fill this joint opening 2 which may be in a bridge, roadway, or similar construction. The seal apparatus 1 is fastened to the joint faces 3, 3 and made entirely waterproof by means of an adhesive bonding material 6.

Figure 2:
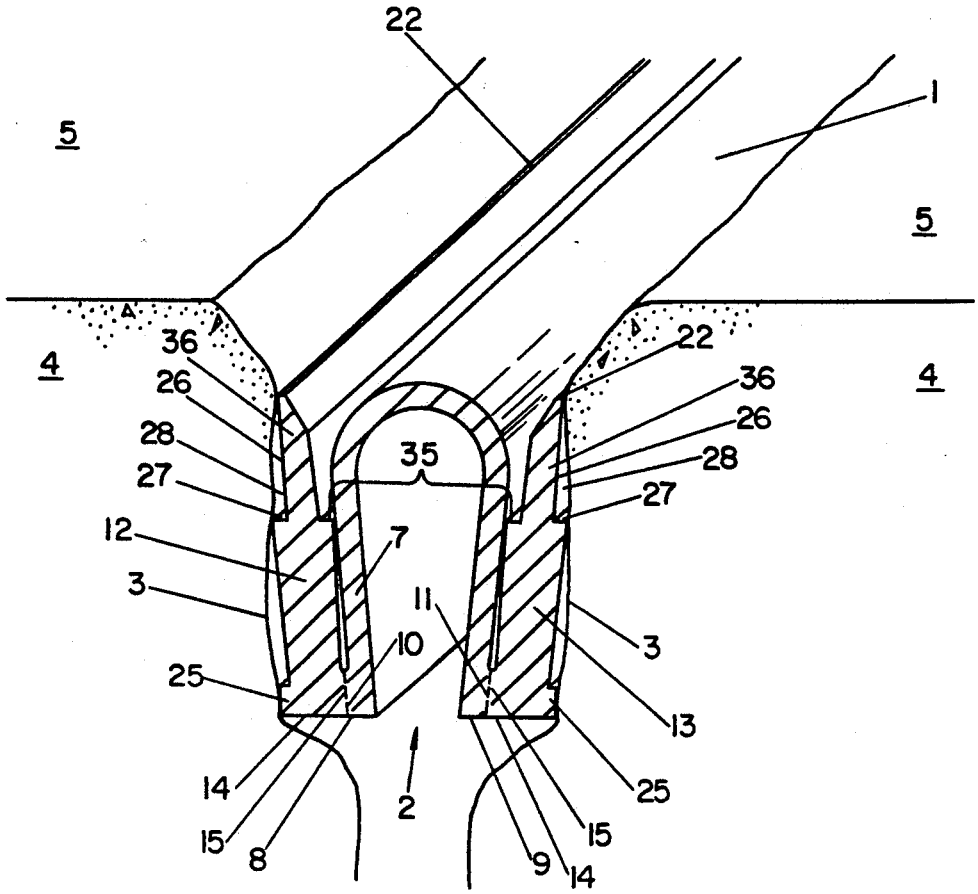
FIG. 2 is a perspective view similar to FIG. 1 which illustrates the same seal within a joint opening prior to injection of an adhesive bonding material.

Referring now to FIG. 2, the seal apparatus 1 comprises an elongated web shaped elastomeric body member 7 having first and second opposed elongated borders 8, 9. The first elongated border 8 is contiguous with an elongated first external edge 10, and the second elongated border 9 is contiguous with an elongated second external edge 11.

Also indicated are the first and second web shaped elastomeric side flaps 12, 13. Each of the side flaps 12, 13 is elongated and has a first elongated border 14. Each of these first borders 14, 14 is contiguous with a first elongated inner edge 15. The first inner edge 15 of the first side flap 12 is fixed unitarily to the first external edge 10 of the body member 7, and the first inner edge 15 of the second side flap 13 is fixed unitarily to the second external edge 11 of the body member 7 throughout the entire longitudinal extent thereof.

Each of the side flaps 12, 13 includes an outer surface 16 (see FIG. 3) which is disposed in generally face to face abutting relationship to the joint face 3 after installation of the apparatus 1 in the joint opening 2. Each of the side flaps 12, 13 further includes an inner surface 17 which is opposite to the outer surface 16.

Each of the side flaps 12, 13 also includes an elongated second border 22 which is remote from the first border 14. The second borders 22, 22 are disposed substantially nearer to the surfaces 5, 5 of the structural members 4, 4 than are the first borders 14, 14 after the installation of the apparatus 1 in the joint opening 2.

The body member 7 is further dimensioned and configured so that the first and second opposed borders 8, 9 of said body member are disposed more remote from each other prior to installation of the apparatus 1 in the joint opening 2 than are said opposed borders after installation of the apparatus 1 in the joint opening 2. The body member 7 thereby exhibits springlike behavior upon insertion of the apparatus 1 in the joint opening 2 which results in said body member urging said side flaps 12, 13 outwardly against the joint faces 3, 3. This springlike behavior may be clearly seen by comparing the body member 7 of FIG. 3 to the body member 7 of FIG. 4.

It is this springlike behavior which secures the seal apparatus 1 in place until the adhesive bonding material 6 has cured. This property makes it unnecessary under most conditions to provide any temporary means of support during the installation and cure period. This springlike behavior is also not affected at all by the installation techniques required for the adhesive bonding material 6. Obviously, there is a clear advantage in providing a seal 1, which can be installed in such a "springlike" manner for as wide a joint opening 2 as possible, and many of the various components of the present invention are designed for this end.

The body member 7 effectively stops the passage of water, and yet remains flexible enough to accommodate a variety of joint movements. The bowed contour of the body member 7, which shape said body member assumes after insertion, and which is shown in FIGS. 1 and 2, is also a naturally strong configuration which will resist loading and debris.

The body member 7 is preferably about 3/16" thick (as measured between an external surface 18 and an internal surface 23) for the seal apparatus 1 used in typical bridge joint applications.

Referring again to FIG. 3, the angular relationship between the side flaps 12,13 and the body member 7 is indicated, and is shown in the drawing by a phi angle ($\phi$). This phi angle is the angle formed by the inner surface 17 with a line 21 tangential to the external surface 18 of the body member proximate to the external edge 10,11 of the body member 7. This phi angle can vary greatly, although it most generally will be within a range between 0 degrees and 50 degrees prior to insertion of the apparatus in a joint opening. It has also been found that a phi angle ranging from about 10 degrees to about 30 degrees helps greatly to position the second borders 22,22 tangential to the joint faces 3,3.

The side flaps 12, 13 and the body member 7 are further dimensioned and configured so that each of the second borders 22, 22 are disposed generally tangential to the respective joint faces 3, 3 after insertion of the apparatus 1 in the joint opening 2. This is desirable because it improves the performance of the adhesive bonding material 6 at the time of installation.

The invention 1 is a unitary body, which is obviously desirable to achieve watertightness.

In many forms of the invention the apparatus 1 has a Shore "A" Durometer rating ranging from about 50 to about 70. A Shore "A" Durometer rating within this range and most preferably about 60 has been found to offer the best balance between rigidity and flexibility. Rigidity is desirable so the apparatus 1 can maintain its bowed contour against dirt, debris, and loadings. Flexibility is desirable so that undue stresses are not generated by the body member 7 and then transmitted to the adhesive bonding material 6, since this might cause a tearing failure.

The seal apparatus 1 is preferably extruded or formed from neoprene. Other materials of elastomeric composition may also be utilized for many applications. The elastomeric material comprising the seal apparatus 1 should further be characterized by good resistance to weathering, chemicals, and ultraviolet radiation. Depending on the application, the elastomer should also contain any other additives or fillers required to insure flexibility at the anticipated ambient temperatures as well as those that may be required for the fabrication process.

In many forms of the invention the apparatus 1 is generally symmetrical about a plane 24 (see FIG. 3) which bisects said apparatus.

Each of the outer surfaces 16, 16 of each of the side flaps 12, 13 includes a first step 25. The first step 25 may extend longitudinally with respect to the side flaps 12, 13. The first step 25 may be proximate to the first border 14 of each of the side flaps 12, 13. This first step 25 may be dimensioned and configured so that the apparatus 1 proximate to the first border 14 of the side flaps 12, 13 has a greater thickness than at other parts thereof. The first steps 25, 25 help in many cases to insure that the second borders 22, 22 are disposed proximate to the joint faces 3, 3.

It should be noted at this point that the first step 25 of each of the side flaps 12, 13 should project outwardly about ¼" relative to an adhesively bonded surface 26 (which is the adhesively bonded portion of the outer surface 16) for the seal apparatus 1 to be used in typical bridge joint applications and about 3/16" outwardly for smaller seals.

Each of the outer surfaces 16, 16 of each of the side flaps 12, 13 may include a second step 27. The second step 27 may extend longitudinally with respect to the side flaps 12, 13. The second step 27 may be dimensioned and configured so that said second step projects outwardly at least 1/16" relative to the adhesively bonded surface 26, said adhesively bonded surface extending longitudinally with respect to the side flaps 12, 13. The adhesively bonded surface 26 is disposed along the outer surface 16 of each of the side flaps 12, 13. The adhesively bonded surface 26 extends from the second border 22 to the external flap line 29, said external flap line being disposed along the outer surface 16 and being further disposed about ¾" below the second border 22. The second step 27 may be dimensioned and configured so that the second step 27 is proximate to the external flap line 29.

The second step 27 may also be dimensioned and configured so that it extends from the external flap line 29 to the first border 14. In many cases the second step 27 may be dimensioned and configured so that the second step 27 projects outwardly about 1/16" relative the adhesively bonded surface 16. It has been found that if the second step 27 projects outwardly about 1/16" relative to the adhesively bonded surface 26 then especially efficient side gaps 28,28 are created by these second steps 27,27 which helps greatly with the injection and dispersion of the adhesive bonding material 6.

It has been found that locating the second step 27 about ¾" below the second border 22 is the distance which provides in many cases a seal apparatus 1 that is dimensionally stable under various installation conditions and yet still provides a reasonably large adhesively bonded surface 26.

Figure 5:
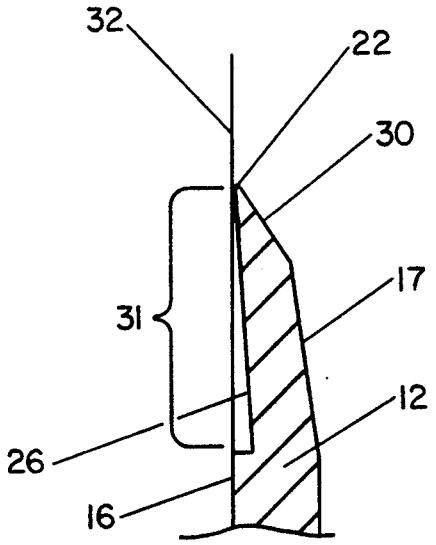
FIG. 5 is a cross-section showing the second border of one of the side flaps of the seal of FIG. 1 in greater detail.

Referring now to FIG. 5, the beveled edge 30 on the inner surface 17 of the first side flap 12 is indicated. The outward bias 31 of the first side flap 12 is also indicated. Of course, it is to be understood that the second side flap 13 could also have been used for FIG. 5 since the following statements concerning the beveled edge 30 and the outward bias 31 pertain equally to the second side flap 13. The beveled edge 30 is contiguous with the second border 22. The beveled edge 30 is preferably oriented at approximately a one horizontal to two vertical, leaving a second border 22 of width about 1/16". It has been found that these dimensions decrease the vulnerability of the side flaps 12, 13 to damage. The beveled edges 30, 30 also simplify the screeding operation described below.

Also indicated in FIG. 5 is the outward bias 31 of the side flap 12. Fabricating the side flap 12 outward as indicated in FIG. 5 so that the second border 22 is at least tangential to a plane 32 projected from the outer surface 16 of the second step 27 assists in the troweling and screeding operations described below. The outward bias 31 accomplishes this by causing the second border 22 of this side flap 12 to "snap" outwardly towards the joint face 3 after the injection and troweling of the adhesive bonding material 6. This property causes pressure to be applied to the adhesive bonding material 6 by the side flap 12 which promotes good adhesion all around.

The inner surface 17 of each of the side flaps 12, 13 may include a third step 35. The third step 35 may extend longitudinally with respect to the side flaps 12, 13. The thickness of this third step 35 can range up to about ½", and is very useful in the event that it is desirable to span an existing joint opening 2 that is unusually wide which thereby avoids costly reconstruction of the joint faces 3,3.

The third step 35 may be dimensioned and configured so that the first border 14 has a greater width than if the third step 35 was not a part of the apparatus 1. The third step 35 may extend from an internal flap line 33 to the first border 14. The internal flap line 33 may be disposed about ¾" below said second border of said side flap, said internal flap line being further disposed along the inner surface 17 of said side flap.

The upper portion of each of the side flaps 12, 13, extending between the second border 22 and downward to the flap lines 29 and 33 is termed herein the upper side flap 36. The upper side flaps 36, 36 are preferably about 3/16" maximum thickness for the seal 1 to be used in many typical bridge joint applications but could be less for other applications.

Referring again to FIG. 3, the width of the body member 7 can vary, but for many typical bridge joint applications would best be about 4.25". This is because in many bridge joint applications a side flap height of about 1.94" (as measured for either of the first or second side flaps 12, 13 between a first border 14 and a second border 22) would generally be the most efficient, and the width of the body member 7 may be about 2.2 times the height of either of the side flaps 12, 13. The width is measured laterally along the internal surface 23 of the body member 7 between the first and second opposed borders 8,9. This relationship between the height of either of the side flaps 12, 13 and the width of the body member 7 may be important in some cases because if a narrower body member 7 is used the seal 1 may lose the ability to be installed at wider joint openings. If the body member 7 is made much wider, however, the body member 7 tends to protrude excessively upward thereby making it more vulnerable to traffic loadings, and certain other problems arise which can complicate the injection of the adhesive bonding material 6.

Figure 3:
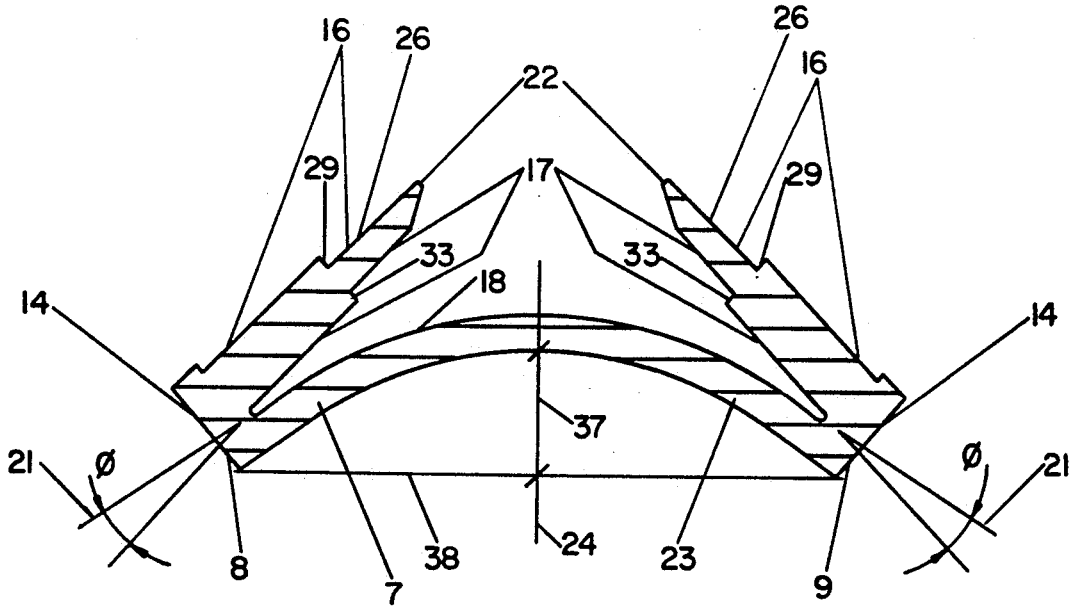
FIG. 3 is a typical cross-sectional view of the seal of FIG. 1 which illustrates the seal apparatus prior to installation into a joint opening and thus without any pressure being applied to the sides thereof as when the seal is installed in a joint.
Figure 4:
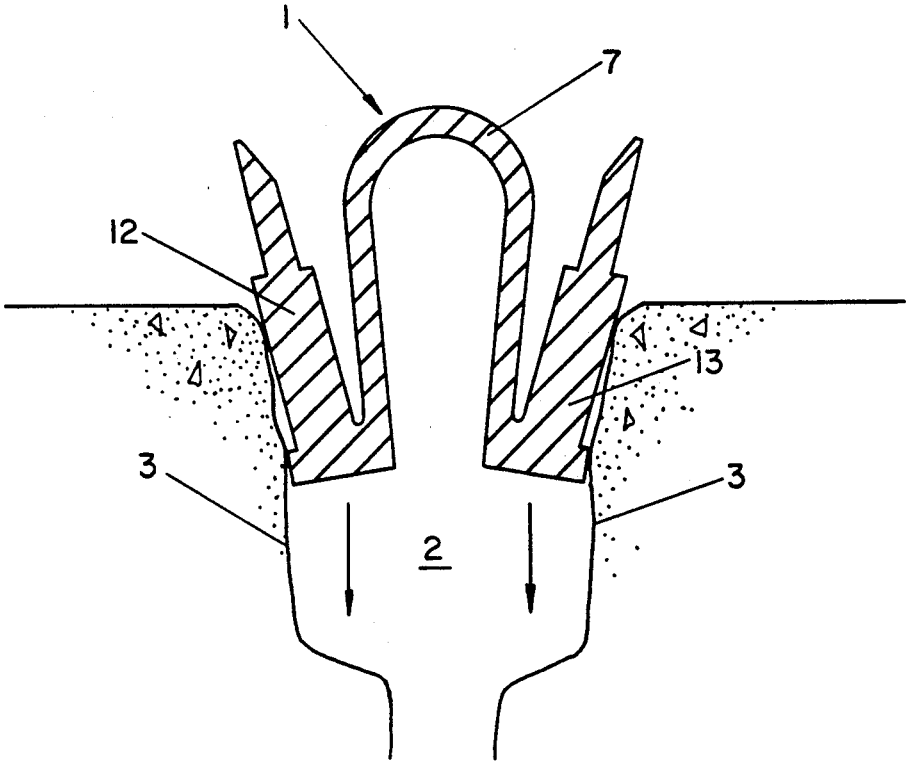
FIG. 4 is a cross-section view showing the initial insertion of the seal of FIG. 1 into a joint opening.

The seal apparatus 1 may be extruded or formed as indicated in FIG. 3, such that the body member 7 has a slightly bowed contour as viewed in a plane extending laterally or cross-sectionally through said body member. It will be understood that the bow may be arcuate or parabolic. The fabricated rise 37 of the body member 7 is indicated between the internal surface 23 of the body member 7 and a chord 38 extending between the first and second opposed elongated borders 8,9 of the body member 7.

The rise 37 may be about 1/7th of the width (lateral extent) of the body member 7 as best seen in FIG. 3 which shows the apparatus 1 prior to its installation into a joint opening 2. The rise 37 is measured along the plane 24 which is the bisector of the chord 38. By means of example, a body member 7 of width of about 4.25" (as measured laterally along the internal surface 23 between the opposed borders 8, 9) would preferably have a rise 37 of about 0.625". The primary advantage of fabricating the seal apparatus 1 so that it has a fabricated rise 37 as indicated herein is that it may improve the range of joint width openings that can be spanned by the seal apparatus 1 at the time of installation.

Figure 6:
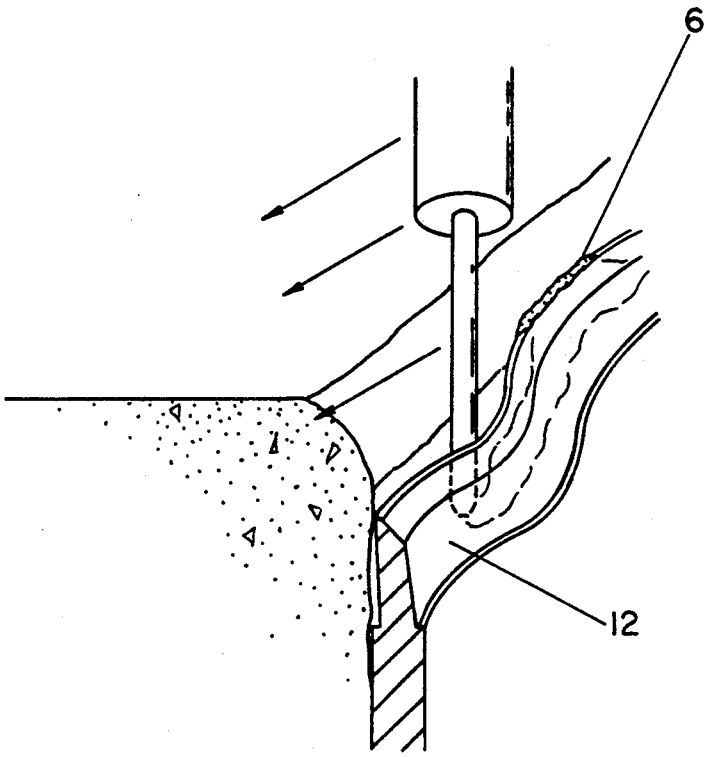
FIG. 6 is a partially sectional perspective view showing the injection of an adhesive bonding material along one of the side flaps of the seal.
Figure 7:
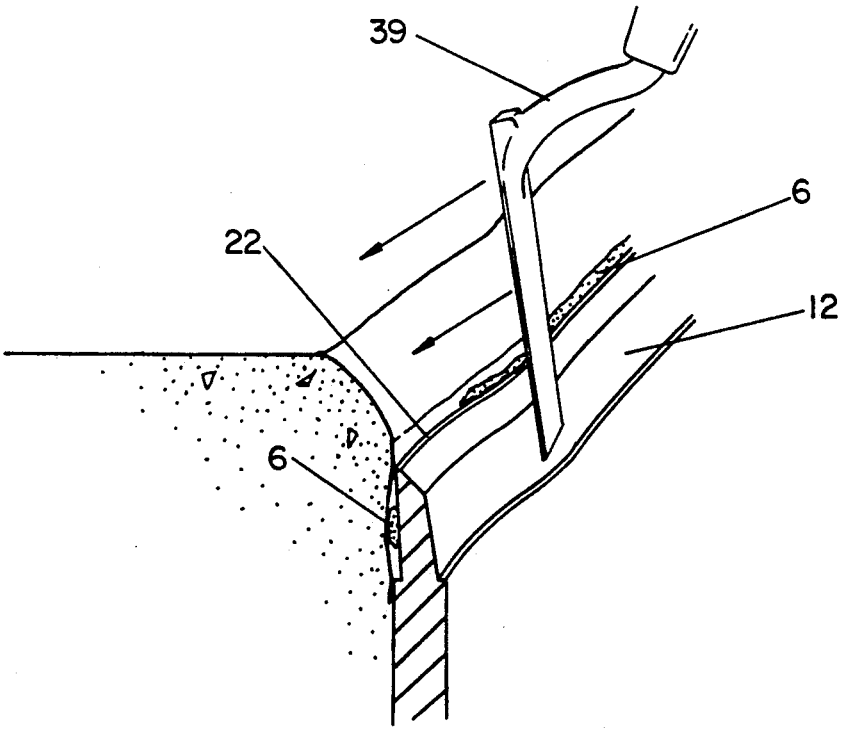
FIG. 7 is a perspective view in partial section of a troweling operation to smooth an adhesive bonding material along one of the side flaps.
Figure 8:
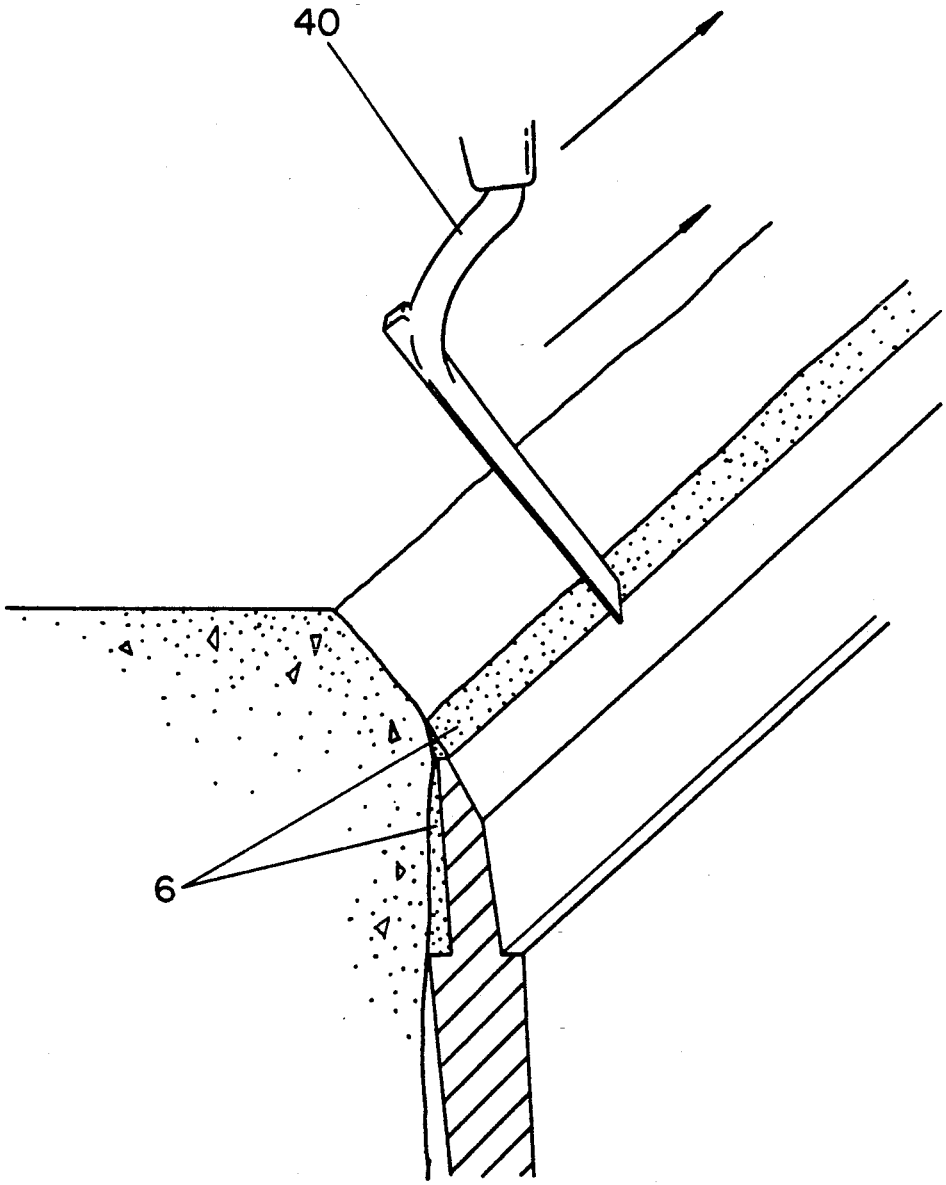
FIG. 8 is a partially sectional perspective view illustrating the screeding operation of the adhesive bonding material along one of the side flaps.

FIG. 6 shows how the first side flap 12 (or equivalently the second side flap 13) can be temporarily bent inward in order to inject the adhesive bonding material 6. FIG. 7 illustrates how some of the adhesive bonding material 6 is extruded after a troweling tool 39 is used to squeeze out excess adhesive bonding material 6. This troweling, which is a rapid operation, ensures that the adhesive bonding material 6 is properly spread around within the side gaps 28,28. The excess, squeezed out adhesive bonding material 6, on top of a second border 22, should be lightly screeded as indicated in FIG. 8. This screeding, which can be accomplished by a screeding tool 40, is also a fast and simple procedure. This screeding creates a "nosing" for the second borders 22, 22 which provides them with a maximum level of protection.

The adhesive bonding material 6 which is used to secure the seal apparatus 1 into the joint opening 2 and to effectively seal up the side gaps 28,28 must be waterproof, tear and puncture resistant, and form a sufficiently strong bond to the joint faces 3,3 and to the side flaps 12, 13. Preferably the adhesive bonding material 6 should retain a measure of flexibility after it has cured, or at a minimum it must not cause thermal compatibility problems with whatever material the joint faces 3, 3 consist of. So-called flexible epoxy products, and especially those which pass ASTM C-884 (thermal compatibility of epoxy resins to concrete) and ASTM C-883 (effective shrinkage of epoxy resins used with concrete), appear to offer good potential as an adhesive bonding material. The main advantage of flexible epoxies over ordinary epoxies is that they have the ability to relieve thermal stresses at the joint faces 3,3. These thermal stresses could otherwise damage the joint faces 3, 3 (in the form of cracking) if the joint faces consisted of concrete. Epoxy products also have excellent weathering and water resistance properties. Whichever epoxy product is used must be in a sufficiently "non-sagging" formulation, because otherwise loss of material down the side flaps can occur. Preferably, the epoxy should be injected by means of a premeasured, dual cartridge system, which eliminates the problems associated with job site mixing. Epoxy products should be installed under the ambient conditions which are most appropriate for the selected epoxy product.

The epoxy products can also be successfully bonded to metallic products such as steel. This is important in the event that it is desired to install the seal apparatus 1 into an expansion joint which has joint faces 3, 3 consisting of metal work. Other materials, notably single component silicones, could also be considered for use as the adhesive bonding material 6 to be used with the present invention. The silicone materials may even offer some advantages over epoxies in that they remain extremely flexible at all temperatures, and they can also be successfully applied in colder temperatures (unlike epoxies which typically require a minimum ambient temperature of about 50 degrees).

Preferably, all side flap surfaces which are to be adhesively bonded should be solvent cleaned at the fabrication plant and also just prior to installation to provide clean surfaces to accept the adhesive bonding material 6. Commercially available solvents, such as denatured alcohol, work well for this purpose. The solvent cleaning is a very fast procedure, especially because these types of solvents evaporate within seconds of their application.

The joint faces 3, 3 should also be cleaned prior to installation of the seal 1 by means well known within the art.

Priming of the seal apparatus 1 or of the joint faces 3, 3 should of course also be carried out if this is deemed necessary.

The present invention should preferably be recessed about ½" below the surfaces 5,5 of a roadway to protect it from traffic loads. This amount of recession also provides for beveling of the structural members 4,4 at the upper portions of the joint opening 2, which is important to avoid chipping of said structural members.

Regarding maintenance, the present invention can be removed fairly easily should the need for replacement arise. A strong upward pull on the seal apparatus 1 while bending it out of the joint opening 2 will dislodge it. The old adhesive bonding material 6 could then be sawcut out or sandblasted away. Possibly, a new seal apparatus 1 could be bonded directly to any old, remaining adhesive bonding material if it is in sound condition and is properly cleaned.

The seal 1 prevents the harmful passage of water through a joint opening 2 by the cooperation of the adhesive bonding material 6 which fills in the side gaps 28, 28 between the side flaps 12, 13 of the seal apparatus 1 and the joint faces 3, 3. The adhesive bonding material 6 also transfers stresses from the seal apparatus 1 to the joint faces 3, 3 more evenly than can be accomplished by other commonly employed means such as clamping plates, anchor bolts, and the like. The adhesive bonding material thus eliminates concentrated stresses which might tend to damage a seal and thereby impair its sealing ability. In addition, loadings in the present invention are transmitted by the body member 7 to the lowermost portions of the seal apparatus 1, and thence to the lower portions of the adhesively bonded surfaces 26, 26, instead of merely transmitting such loadings to the uppermost portions of a seal apparatus as various other designs do. The advantage of this approach is that it is extremely important to minimize loading stresses on the second borders 22, 22 of the side flaps 12, 13, since they are constantly exposed to a formidable array of conditions including the elements, dirt, and traffic, and including tensile stresses with these other detrimental effects would almost certainly result in premature pulling away of the apparatus from the joint faces 3, 3. Indeed, this is precisely what happens in the commonly employed joint-seal joints, wherein an elastic material, such as silicone, or various hot-poured materials, are simply pumped or poured into a joint opening underlain by a foam back-up rod. This sort of joint typically has a short life span because the severe combination of water, traffic, dirt and tensile stresses ends up being concentrated on the uppermost portions of such joints and an adhesive failure is almost guaranteed.

In the preferred form of the invention there are no metal plates, angles, or extruded "jaws", etc. which are collectively referred to herein as "metal work". This form of the invention avoids the maintenance and installation problems associated with metal work. Although such metal work is not necessary to the invention it will be understood that some forms of the invention will cooperate with such structures. The adhesive bonding material must be carefully selected in such cases to effect good adhesion to the metal work.

The construction of the inventive apparatus also makes possible sharp upturns, downturns, or sideways angular bends of the seal 1 to cooperate with joint openings having such contours. For these types of angular bends, the present invention could be miter cut and adhesively rejoined, or, it is believed, miter cut and shop vulcanized back into a unitary, angular bend which would be the preferred form of such an angular bend. The flexibility of the present apparatus also makes it possible to simply bend the seal apparatus 1 upwards at a fairly tight radius. The radius should be large enough so that the body member 7 maintains its bowed shape, i.e., such that it does not buckle. The adhesive bonding material 6 performs admirably in filling in the resulting wrinkles in the side flaps 12, 13. This treatment could typically be employed at the curb line of bridges and similar structures and especially if sufficient room for such a gradual upturn was available.

The seal 1 will also readily accommodate changes in the roadway cross slope, as well as width variation (or "waviness") of the joint opening 2 because of the inherent flexibility of the seal apparatus 1 including the side flaps 12, 13. In addition, the present invention also offers good resistance to the accumulation of excessive foreign matter such as sand and gravel because of the bowed shape of the body member 7 which pushes such foreign matter up and out of the joint opening 2 as soon as the seal apparatus 1 is squeezed tightly by the structural members 4, 4.

The present seal apparatus 1 also offers significant advantages over other types of expansion joints and seals in that in many of its various sizes it has a very short installed cross section. For example, a seal apparatus 1 for typical bridge applications has an installed height of only about 2". This is very useful because these low height conditions are extremely common in today's "rehab" bridgework.

Other advantages over existing expansion joints and seals include quietness under traffic conditions, its ease of handling, shipping, and storage (it can be easily rolled up or folded), its ability to accommodate movements caused by "skewed" joints, its ability to handle so-called "dog-leg" conditions found at some curbs, its very low load resistance to structural movements, its excellent recovery properties after periods of prolonged compression, its ease of fabrication (typically by extrusion), its overall toughness under construction conditions, its ability to accommodate "steps" or misalignments within the joint faces, and its ease of installation under stage construction conditions-which is owed once again to its inherent bendability.

The invention has been described in detail with particular reference to preferred embodiments, but it will be understood that variations and modifications can be effected within the spirit and scope of the invention.

Having thus described my invention I claim:

1. An elongated seal apparatus for adhesive installation in a structural joint opening having spaced generally planar, generally parallel spaced faces which comprises in combination:

an elongated web shaped elastomeric body member having first and second opposed elongated borders, said first elongated border being contiguous with an elongated first external edge, said second elongated border being contiguous with an elongated second external edge;

first and second web shaped elastomeric side flaps, each of said side flaps being elongated and having a first elongated border, each of said first borders being contiguous with a first elongated inner edge, said first inner edge of said first side flap being fixed unitarily to said first external edge of said body member throughout the entire longitudinal extent thereof, said first inner edge of said second side flap being fixed unitarily to said second external edge of said body member throughout the entire longitudinal extent thereof;

an outer surface of each of said side flaps, said outer surface being disposed in generally face to face abutting relationship to said joint face after installation of said apparatus in said joint opening, each of said side flaps further comprising an inner surface, said inner surface being opposite to said outer surface;

an external surface of said body member, said external surface being contiguous with said external edges, said body member further comprising an internal surface, said internal surface being opposite to said external surface;

an angular relationship between each of said side flaps and said body member prior to insertion of said apparatus in said joint opening, the angle being measured between said inner surface and a tangential line, said line being tangential to said external surface proximate to said external edge of said body member, said angle being within a range from about 0 degrees to about 50 degrees;

an elongated second border of each of said side flaps, said second border being remote from said first border of said side flap;

said body member being further dimensioned and configured so that said first and second opposed borders of said body member are disposed more remote from each other prior to insertion of said apparatus in said joint opening than are said opposed borders after insertion of said apparatus in said joint opening, said body member thereby exhibiting springlike behaviour upon insertion of said apparatus in said joint opening which results in said body member urging said side flaps outwardly against said joint faces;

each of said side flaps and said body member being further dimensioned and configured so that said second border of said side flap is disposed generally tangential to said joint face after insertion of said apparatus in said joint opening;

a first step, said first step extending longitudinally along said outer surface of each of said side flaps, said first step being proximate to said first border of said side flap, said first step being dimensioned and configured so that said apparatus proximate to said first border of said side flap has a greater thickness than at other parts thereof.

2. The apparatus as described in claim 1 wherein:

each of said outer surfaces of said side flaps includes a second step, said second step extending longitudinally with respect to said side flap, said second step being dimensioned and configured so that said second step projects outwardly about 1/16" relative to an adhesively bonded surface, said adhesively bonded surface extending longitudinally with respect to said side flap, said bonded surface being further disposed along said outer surface of said side flap from said second border to an external flap line, said external flap line being disposed along said outer surface, said external flap line being further disposed about ¾" below said second border, said second step being further disposed so that it is proximate to said external flap line.

3. The apparatus as described in claim 2 wherein: said second step extends from said external flap line to said first border.

4. The apparatus as described in claim 3 wherein: each of said side flaps is dimensioned and configured so that said second border of said side flap is tangential to a plane projected from said outer surface of said second step prior to insertion of said apparatus in said joint opening.

5. The apparatus as described in claim 4 wherein: each of said second borders is contiguous with a beveled edge, said beveled edge being contiguous with said inner surface of said side flap, said beveled edge having a slope of about two vertical to one horizontal, said beveled edge extending longitudinally with respect to said side flap.

6. The apparatus as described in claim 5 wherein: each of said inner surfaces includes a third step, said third step extending longitudinally with respect to said side flap, said third step being dimensioned and configured so that said first border of said side flap has a greater width than if the third step was not a part of the apparatus, said third step being further dimensioned and configured so that said third step extends from an internal flap line of said side flap to said first border of said side flap, said internal flap line being disposed about ¾" below said second border of said side flap, said internal flap line being further disposed along said inner surface of said side flap.

7. The apparatus as described in claim 6 wherein: said body member has a width of about 2.2 times the height of said side flap, said width being measured laterally along said internal surface of said body member between said opposed borders of said body member, said height being measured between said first border and said second border of said side flap.

8. The apparatus as described in claim 7 wherein: said body member has a fabricated rise of about 1/7th of the width of said body member prior to insertion of said apparatus in said joint opening, said width being measured laterally along said internal surface of said body member between said first border and said second border of said body member, said rise being measured along a plane between a chord and said internal surface of said body member, said plane being the bisector of said chord, said chord extending between said opposed borders of said body member.

* * * * *